US010959020B2

(12) United States Patent
Goto et al.

(10) Patent No.: US 10,959,020 B2
(45) Date of Patent: Mar. 23, 2021

(54) AUDIO SIGNAL CONTROL CIRCUIT AND AUDIO SIGNAL CONTROL METHOD

(71) Applicant: Yamaha Corporation, Hamamatsu (JP)

(72) Inventors: Mitsutaka Goto, Hamamatsu (JP); Ken Iwayama, Hamamatsu (JP); David Hatmaker, Anaheim Hills, CA (US)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 16/727,489

(22) Filed: Dec. 26, 2019

(65) Prior Publication Data

US 2020/0213734 A1 Jul. 2, 2020

(30) Foreign Application Priority Data

Dec. 28, 2018 (JP) ..... JP2018-247250

(51) Int. Cl.
*H04R 3/04* (2006.01)
*H04R 29/00* (2006.01)

(52) U.S. Cl.
CPC ..... *H04R 3/04* (2013.01); *H04R 29/001* (2013.01); *H04R 2430/01* (2013.01)

(58) Field of Classification Search
CPC .... H04R 2430/01; H04R 29/001; H04R 3/04; H04R 3/12; H04R 3/14
USPC ..... 381/56, 61, 98, 99, 100, 102, 103; 327/553
See application file for complete search history.

(56) References Cited

U.S. PATENT DOCUMENTS 3,755,749 A * 8/1973 Van Ryswyk ..... H03H 11/1217 327/553
5,930,374 A * 7/1999 Werrbach ..... H04R 3/14 381/99
7,085,389 B1 * 8/2006 Modafferi ..... H04R 3/14 381/100
7,356,150 B2 * 4/2008 Ejima ..... G10L 21/038 381/61
2007/0121964 A1 * 5/2007 Rumreich ..... H04R 3/14 381/99
2009/0107322 A1 * 4/2009 Akiyama ..... G10H 1/0091 84/616
2010/0260356 A1 * 10/2010 Teramoto ..... H04R 3/14 381/120
2015/0263690 A1 * 9/2015 Goto ..... H03G 7/002 381/56
2016/0276992 A1 * 9/2016 Vilermo ..... H03G 5/165

FOREIGN PATENT DOCUMENTS

JP 2013-255049 A 12/2013

* cited by examiner

*Primary Examiner* — Vivian C Chin
*Assistant Examiner* — Friedrich Fahnert
(74) *Attorney, Agent, or Firm* — Crowell & Moring LLP

(57) ABSTRACT

An audio signal control circuit includes an adjustment signal generator that extracts a frequency band, which includes a frequency at which a frequency band shared by a low-range speaker and a frequency band shared by a high-range speaker overlap each other, to generate an adjustment signal Sck; a high-range outputter that subtracts the adjustment signal Sck from an audio signal Sa to generate a high-range audio signal SaH and outputs it to a high-pass filter; and a low-range outputter that adds the adjustment signal Sck to the audio signal Sa to generate a low-range audio signal SaL and outputs it to a low-pass filter.

6 Claims, 10 Drawing Sheets

AUDIO SIGNAL CONTROL CIRCUIT AND AUDIO SIGNAL CONTROL METHOD

CROSS REFERENCE TO RELATED APPLICATIONS

This Nonprovisional application claims priority under 35 U.S.C. § 119(a) to Patent Application No. 2018-247250 filed in Japan on Dec. 28, 2018 the entire contents of which are hereby incorporated by reference.

BACKGROUND OF THE INVENTION

1. Field of the Invention

One embodiment of the invention relates to an audio signal control circuit that generates a high-range audio signal and a low-range audio signal from an audio signal and outputs them, and an audio signal control method.

2. Description of the Related Art

The amplifier device described in Unexamined Japanese Patent Publication No. 2013-255049 includes an HPF (High-pass Filter), an LPF (Low-pass Filter), and a BPF (Bandpass Filter). The amplifier device is connected to a speaker. A coefficient $\alpha$, which is set in the amplifier device, is determined according to specifications of the speaker. The amplifier device multiplies an output signal of the BPF by the coefficient $\alpha$. The amplifier device adds this signal to an output signal of the LPF. The amplifier device multiplies the output signal of the BPF by a coefficient $(1-\alpha)$. The amplifier device adds this signal to an output signal of the HPF.

The amplifier device supplies the output signal of the HPF to a tweeter. The amplifier device supplies the output signal of the LPF to a woofer. Thus, the amplifier device changes a crossover frequency, statically.

The amplifier device described in Unexamined Japanese Patent Publication No. 2013-255049, however, fixes the coefficient according to specifications of the speaker. This makes it difficult for the amplifier device described in Unexamined Japanese Patent Publication No. 2013-255049 to change a cutoff frequency of the HPF (high-range side filter) and a cutoff frequency of the LPF (low-range side filter) dynamically, according to a level of an audio signal.

SUMMARY OF THE INVENTION

Accordingly, one embodiment of the invention aims to provide an audio signal control circuit that changes a cutoff frequency of the HPF and a cutoff frequency of the LPF dynamically, according to the level of an audio signal.

An audio-signal control circuit includes: an adjustment signal generator that extracts a frequency band, which includes a frequency at which a frequency band shared by a low-range speaker and a frequency band shared by a high-range speaker overlap each other, to generate an adjustment signal; a high-range outputter that subtracts the adjustment signal from an audio signal to generate a high-range audio signal and outputs it to a high-pass filter; and a low-range outputter that adds the adjustment signal to the audio signal to generate a low-range audio signal and outputs it to a low-pass filter.

One embodiment of the invention makes it easy to change a cutoff frequency of an HPF and a cutoff frequency of an LPF dynamically, according to a level of an audio signal.

DETAILED DESCRIPTION OF THE INVENTION (Hardware Configuration of Sound System 1)

Figure 1:
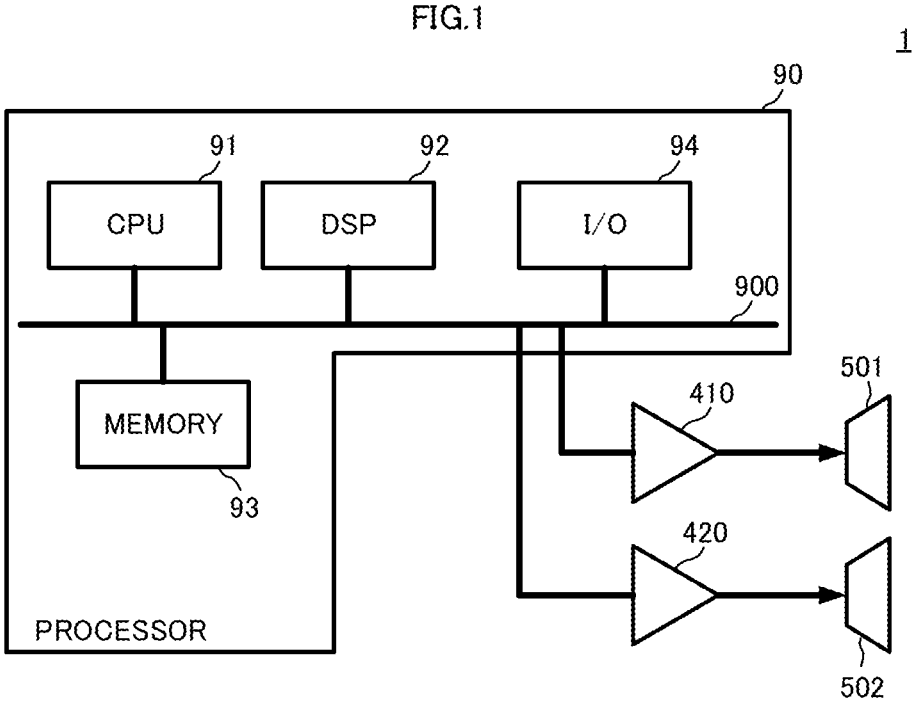
FIG. 1 is a view showing a hardware configuration of a sound system 1.

FIG. 1 is a view showing a hardware configuration of a sound system 1. As shown in FIG. 1, the sound system 1 includes a processor 90, a high-range amplifier 410, a low-range amplifier 420, a high-range speaker 501, and a low-range speaker 502. The processor 90 includes a bus 900, a CPU 91, a DSP 92, a memory 93, and an I/O 94. The CPU 91, the DSP 92, the memory 93, and the I/O 94 are connected with one another through the bus 900.

The Memory 93 stores various kinds of programs, data, and the like. The various kinds of programs include a program for operating each part of the audio signal control circuit 10. The CPU 91 executes the various kinds of programs, which are stored in the memory 93, to achieve the audio signal control circuit 10. It is not limited to the example in which the memory 93 stores various kinds of programs and data. A server or the like connected to an external storage or the network may store the various kinds of programs and the data. In this case, the CPU 91 reads out the various kinds of programs and the data from the server or the like.

Input terminals of the high-range amplifier 410 and the low-range amplifier 420 are connected to the processor 90. The high-range amplifier 410 amplifies a high-range audio signal and outputs it to the high-range speaker 501. The low-range amplifier 420 amplifies a low-range audio signal and outputs it to the low-range speaker 502.

(Configuration of Sound System 1)

Figure 2:
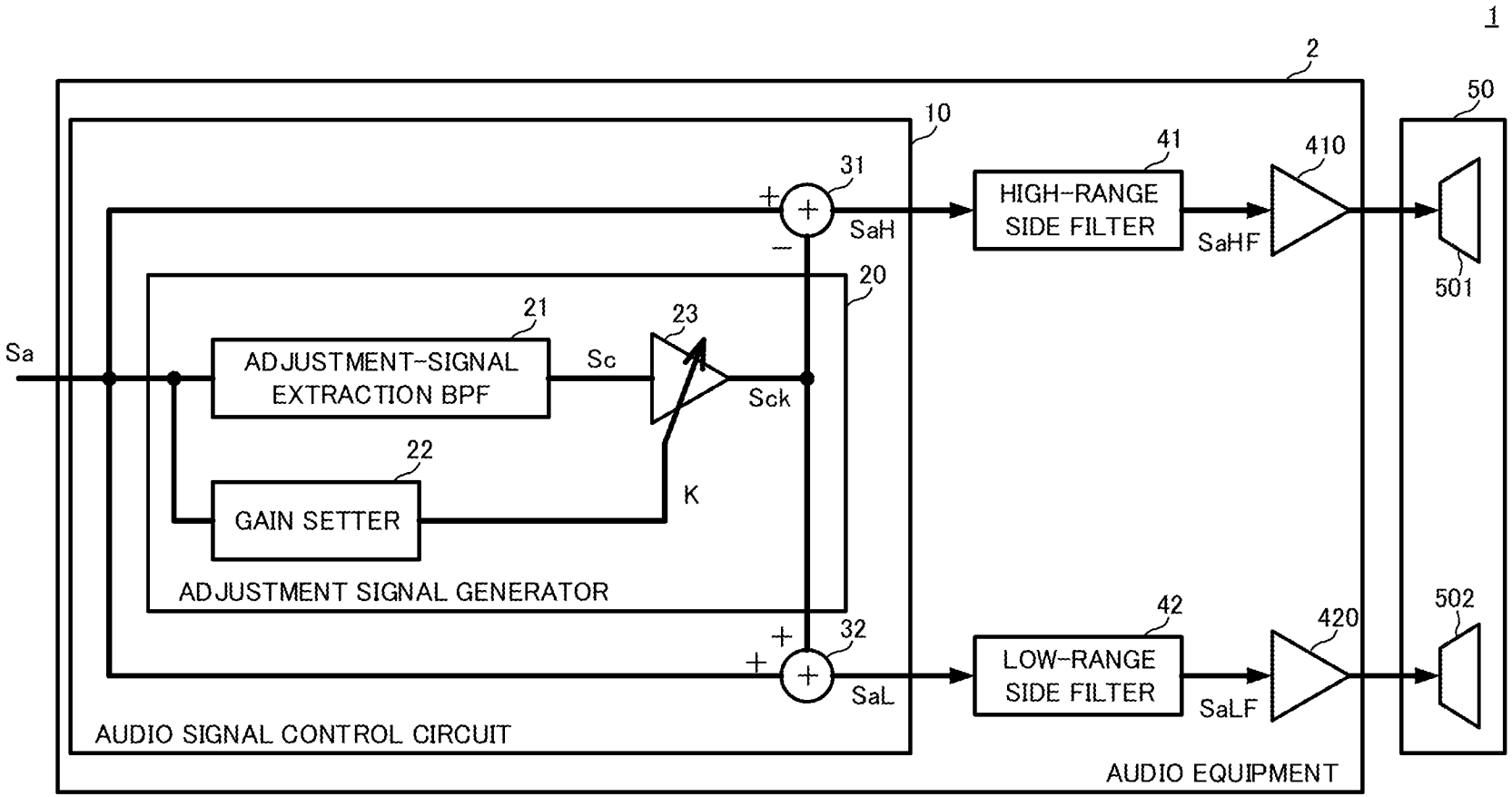
FIG. 2 is a block diagram showing a configuration of the sound system 1.

FIG. 2 is a block diagram showing a configuration of the sound system 1. As shown in FIG. 2, the sound system 1 includes audio equipment 2 and a speaker device 50. The audio equipment 2 is connected to the speaker device 50.

The speaker device 50 includes a high-range speaker (high-range reproduction speaker) 501 and a low-range speaker (low-range reproduction speaker) 502. The high-range speaker 501 and the low-range speaker 502 are accommodated in a housing of the speaker device 50. For instance, the high-range speaker 501 reproduces sounds having a frequency ranging from 200 Hz to 20 kHz. The low-range speaker 502 reproduces sounds having a center frequency ranging from 20 Hz to 400 Hz. A crossover frequency between the high-range speaker 501 and the low-range speaker 502 ranges from approximately 250 Hz to 350 Hz, for example. The crossover frequency is a frequency at which a frequency band shared by the low-range speaker 502 and a frequency band shared by the high-range speaker 501 overlap each other. In other words, the crossover frequency is a frequency at which frequency characteristics of the low-range speaker 502 and frequency characteristics of the high-range speaker 501 overlap each other.

(Configuration of Audio Equipment 2)

The audio equipment 2 amplifies a high-range audio signal SaHF, which is subjected to filter processing, in the high-range amplifier 410 and outputs it to the high-range speaker 501. The high-range speaker 501 converts the high-range audio signal SaHF into a sound, and emits the sound. The audio equipment 2 amplifies a low-range audio signal SaLF, which is subjected to filter processing, in the low-range amplifier 420, and outputs it to the low-range speaker 502. The low-range speaker 502 converts the low-range audio signal SaLF into a sound, and emits the sound.

The audio equipment 2 includes an audio signal control circuit 10, a high-range side filter 41, a low-range side filter 42, a high-range amplifier 410, and a low-range amplifier 420. Each part of the audio equipment 2 is achieved by the above-mentioned processor 90, for example.

Concrete configuration and processing of the audio signal control circuit 10 will be described later. Roughly, the audio signal control circuit 10 generates an adjustment signal Sc from an audio signal Sa that has been inputted. The audio signal control circuit 10 sets a level of the adjustment signal Sc based on a level of the audio signal Sa. The audio signal control circuit 10 generates an adjustment signal Sck whose level has been set.

The audio signal control circuit 10 subtracts the adjustment signal Sck from the audio signal Sa. With this processing, the audio signal control circuit 10 generates a high-range audio signal SaH, and outputs it to the high-range side filter 41.

The audio signal control circuit 10 adds the adjustment signal Sck to the audio signal Sa. With this processing, the audio signal control circuit 10 generates a low-range audio signal SaL, and outputs it to the low-range side filter 42.

The high-range side filter 41 is a high-pass filter (HPF). The high-range side filter 41 has a cutoff frequency fcH0 of approximately 300 Hz, for example. The high-range side filter 41 applies filter processing on the high-range audio signal SaH. The high-range side filter 41 outputs a high-range audio signal SaHF, which is subjected to the filter processing, to the high-range amplifier 410. The high-range amplifier 410 amplifies the high-range audio signal SaHF, and outputs it to the high-range speaker 501.

The low-range side filter 42 is a low-pass filter (LPF). The low-range side filter 42 has a cutoff frequency fcL0 of approximately 400 Hz, for example. The low-range side filter applies filter processing on the low-range audio signal SaL. The low-range side filter 42 outputs a low-range audio signal SaLF, which is subjected to the filter processing, to the low-range amplifier 420. The low-range amplifier 420 amplifies the low-range audio signal SaLF, and outputs it to the low-range speaker 502.

(Configuration of Audio Signal Control Circuit 10)

The audio signal control circuit 10 includes an adjustment signal generator 20, a high-range outputter 31, and a low-range outputter 32. The adjustment signal generator 20 includes an adjustment-signal extraction BPF 21, a gain setter 22, and a level adjuster 23. The adjustment-signal extraction BPF 21 corresponds to "a first bandpass filter" of the present invention.

The adjustment-signal extraction BPF 21 applies bandpass filter processing on the audio signal Sa to generate the adjustment signal Sc. The adjustment-signal extraction BPF has a pass band including the crossover frequency. A lower side cutoff frequency of the adjustment-signal extraction BPF 21 is lower than the cutoff frequency fcL0 of the low-range side filter 42. Furthermore, a higher side cutoff frequency of the adjustment-signal extraction BPF 21 is higher than the cutoff frequency fcH0 of the high-range side filter 41.

Thus, the adjustment signal Sc has a frequency band including the crossover frequency. The frequency band of the adjustment signal Sc has an upper limit frequency substantially the same as the cutoff frequency fcH0, and the upper limit frequency is higher than the cutoff frequency fcH0. The frequency band of the adjustment signal Sc has a lower limit frequency substantially the same as the cutoff frequency fcL0, and the lower limit frequency is lower than the cutoff frequency fcL0. Note that, depending on output characteristics of the high-range speaker 501, a difference between the cutoff frequency fcH0 of the high-range side filter 41 and the upper limit frequency of the frequency band of the adjustment signal Sc can be adjusted as necessary. Further, depending on output characteristics of the low-range speaker 502, a difference between the cutoff frequency fcL0 of the low-range side filter 42 and the lower limit frequency of the frequency band of the adjustment signal Sc can be adjusted as necessary.

Figure 3:
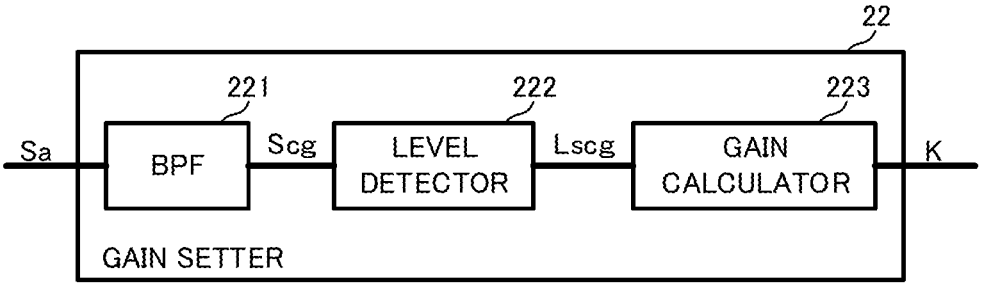
FIG. 3 is a block diagram showing a configuration of a gain setter 22.

FIG. 3 is a block diagram showing a configuration of the gain setter 22. As shown in FIG. 3, the gain setter 22 includes a gain setting BPF 221, a level detector 222, and a gain calculator 223.

The gain setting BPF 221 applies bandpass filter processing on the audio signal Sa. Q (quality factor) of the gain setting BPF 221 differs from Q of the adjustment-signal extraction BPF 21. The gain setting BPF 221 outputs a gain setting audio signal Scg, which is subjected to the filter processing. The gain setting BPF 221 corresponds to "a second bandpass filter" of the present invention. A pass band of the gain setting BPF 221 may be the same as or different from that of the adjustment-signal extraction BPF 21. If the pass band includes a frequency band in which level detection in the vicinity of the crossover frequency can be performed, the gain setting BPF 221 will be acceptable. Furthermore, the pass band of the gain setting BPF 221 may be located on a higher side than the crossover frequency. In other words, if the pass band includes a frequency band in which level detection in the frequency band reproduced by the high-range speaker 501 can be performed, the gain setting BPF 221 will be acceptable.

The level detector 222 detects an envelope of the gain setting audio signal Scg, for example. The level detector 222 detects a level Lscg of the gain setting audio signal Scg from the envelope.

The gain calculator 223 uses the level Lscg to determine a gain K with respect to the adjustment signal Sc. More specifically, the gain calculator 223 stores a gain setting threshold TH in advance. The gain calculator 223 compares the level Lscg with the gain setting threshold TH. If the level Lscg is more than or equal to the gain setting threshold TH, the gain calculator 223 will set the gain K to a predetermined value. If the level Lscg is less than the gain setting threshold TH, the gain calculator 223 will set the gain K so as to decrease the level of the adjustment signal Sc to zero.

The level adjuster 23 is a variable amplifier, for example. The level adjuster 23 multiplies the adjustment signal Sc by the gain K to generate an adjustment signal Sck subjected to a level adjustment.

Thus, if the level of the gain setting audio signal Scg is more than or equal to the gain setting threshold TH, the adjustment signal generator 20 will output the adjustment signal Sck of a predetermined level, rather than zero. On the other hand, if the level of the gain setting audio signal Scg is less than the gain setting threshold TH, the adjustment signal generator 20 will output the adjustment signal Sck of a zero level.

The high-range outputter 31 subtracts the adjustment signal Sck, which is subjected to the level adjustment, from the audio signal Sa to generate a high-range audio signal SaH. The high-range outputter 31 outputs the high-range audio signal SaH to the high-range side filter 41.

The low-range outputter 32 adds the adjustment signal Sck, which is subjected to the level adjustment, to the audio signal Sa to generate a low-range audio signal SaL. The low-range outputter 32 outputs the low-range audio signal SaL to the low-range side filter 42.

(Description of Operational Advantages of Audio Equipment 2 Including Audio Signal Control Circuit 10)

By using such a configuration, the audio equipment 2 including the audio signal control circuit 10 can obtain operational advantages as shown in the following.

(In the Case where Audio Signal Sa is Low Level)

Figure 4:
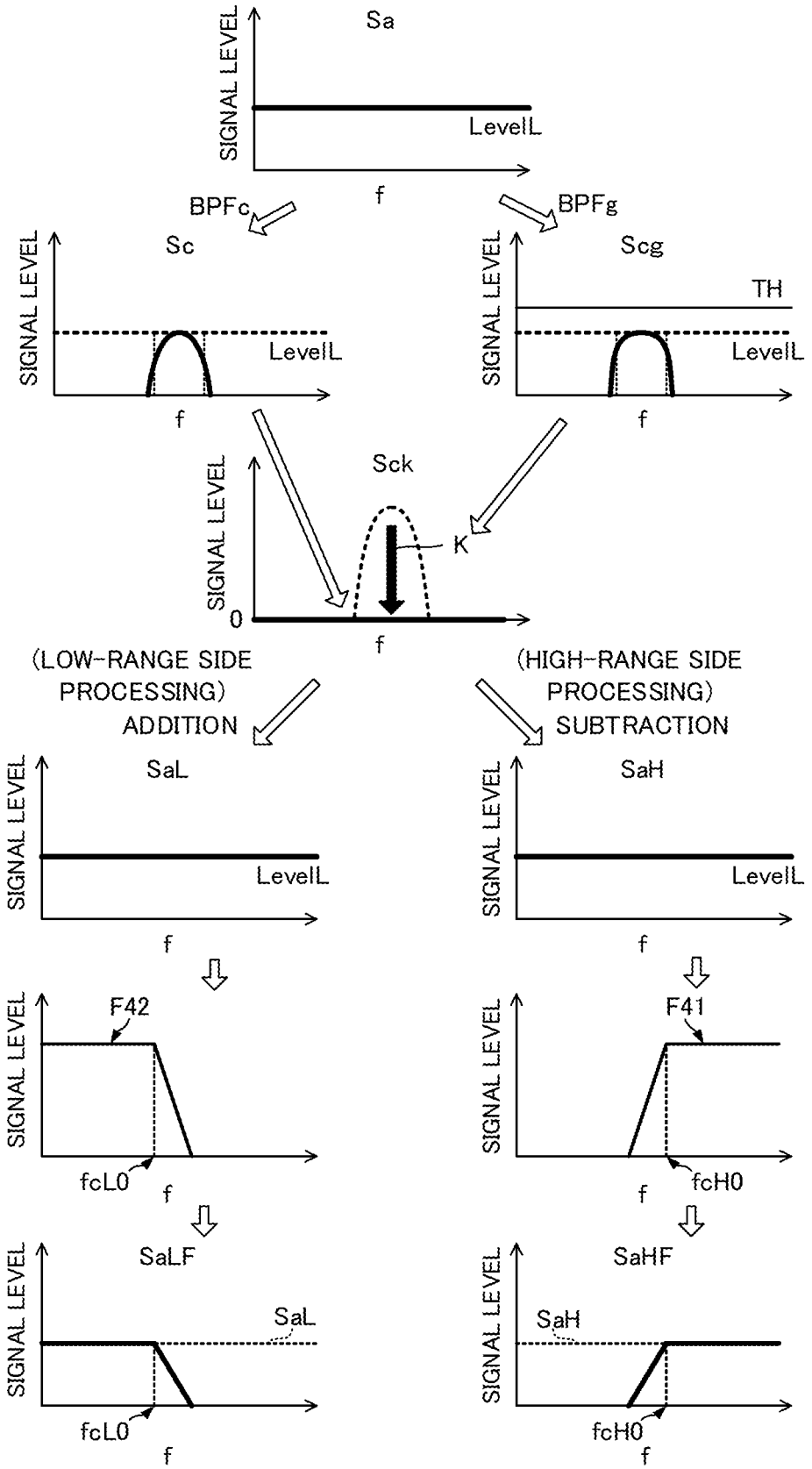
FIG. 4 is a view showing frequency characteristics about a signal level of each signal in audio equipment 2, when a level of an audio signal Sa is low.

FIG. 4 is a view showing frequency characteristics about a signal level of each signal in the audio equipment 2. FIG. 4 shows the case where a level of the audio signal Sa is low.

The adjustment signal Sc is a signal obtained by applying bandpass filter processing on the audio signal Sa in the adjustment-signal extraction BPF 21. Therefore, a level of the adjustment signal Sc is substantially the same as the level of the audio signal Sa.

The gain setting audio signal Scg is a signal obtained by applying bandpass filter processing on the audio signal Sa in the BPF 221 of the gain setter 22. Therefore, a level of the gain setting audio signal Scg is substantially the same as the level of the audio signal Sa. In this case, as mentioned above, Q of the BPF 221 of the gain setter 22 differs from Q of the adjustment-signal extraction BPF 21. Therefore, as shown in FIG. 4, frequency characteristics of the adjustment signal Sc differ from frequency characteristics of the gain setting audio signal Scg. As a result, the gain setting audio signal Scg and the adjustment signal Sc each have optimal frequency characteristics.

As shown in FIG. 4, if the level of the gain setting audio signal Scg is less than the gain setting threshold TH, the gain K will have such a value that the level of the adjustment signal Sc is decreased to zero. Accordingly, as shown in FIG. 4, the adjustment signal Sck, which is subjected to the level adjustment, is a signal whose level is zero over the entire frequency band.

(Processing on Low-Range Side)

The low-range audio signal SaL is a signal obtained by adding the adjustment signal Sck, which is subjected to the level adjustment, to the audio signal Sa. The low-range audio signal SaL is the same as the audio signal Sa, because the adjustment signal Sck, which is subjected to the level adjustment, is a signal of a zero level.

The low-range side filter 42 has a cutoff frequency fcL0 as shown in the frequency characteristic F42 of FIG. 4. The low-range side filter 42 applies filter processing on the low-range audio signal SaL. With this processing, a low-range audio signal SaLF, which is subjected to the filter processing, has a frequency characteristic shown in FIG. 4 (graph on the left-hand side of the bottom). The low-range audio signal SaLF, which is subjected to the filter processing, is a signal constituted by frequency components located on a lower side than the cutoff frequency fcL0 in the low-range audio signal SaL.

The low-range audio signal SaL is the same as the audio signal Sa. Therefore, the low-range audio signal SaLF, which is subjected to the filter processing, is a signal having frequency components located on a lower side than the cutoff frequency fcL0 in the audio signal Sa. Thus, the cutoff frequency fcL0 on the low-range side does not change.

(Processing on High-Range Side)

The high-range audio signal SaH is a signal obtained by subtracting the adjustment signal Sck, which is subjected to the level adjustment, from the audio signal Sa. The high-range audio signal SaH is the same as the audio signal Sa, because the adjustment signal Sck, which is subjected to the level adjustment, is a signal of a zero level.

The high-range side filter 41 has a cutoff frequency fcH0 as shown in the frequency characteristic F41 of FIG. 4. The high-range side filter 41 applies filter processing on the high-range audio signal SaH. With this processing, a high-range audio signal SaHF, which is subjected to the filter processing, has a frequency characteristic shown in FIG. 4 (graph on the right-hand side of the bottom). The high-range audio signal SaHF, which is subjected to the filter processing, is a signal constituted by frequency components located on a higher side than the cutoff frequency fcH0 in the high-range audio signal SaH.

The high-range audio signal SaH is the same as the audio signal Sa. Therefore, the high-range audio signal SaHF, which is subjected to the filter processing, is a signal having frequency components located on a higher side than the cutoff frequency fcH0 in the audio signal Sa. Thus, the cutoff frequency fcH0 on the high-range side does not change.

(In the Case where Audio Signal Sa is High Level)

Figure 5:
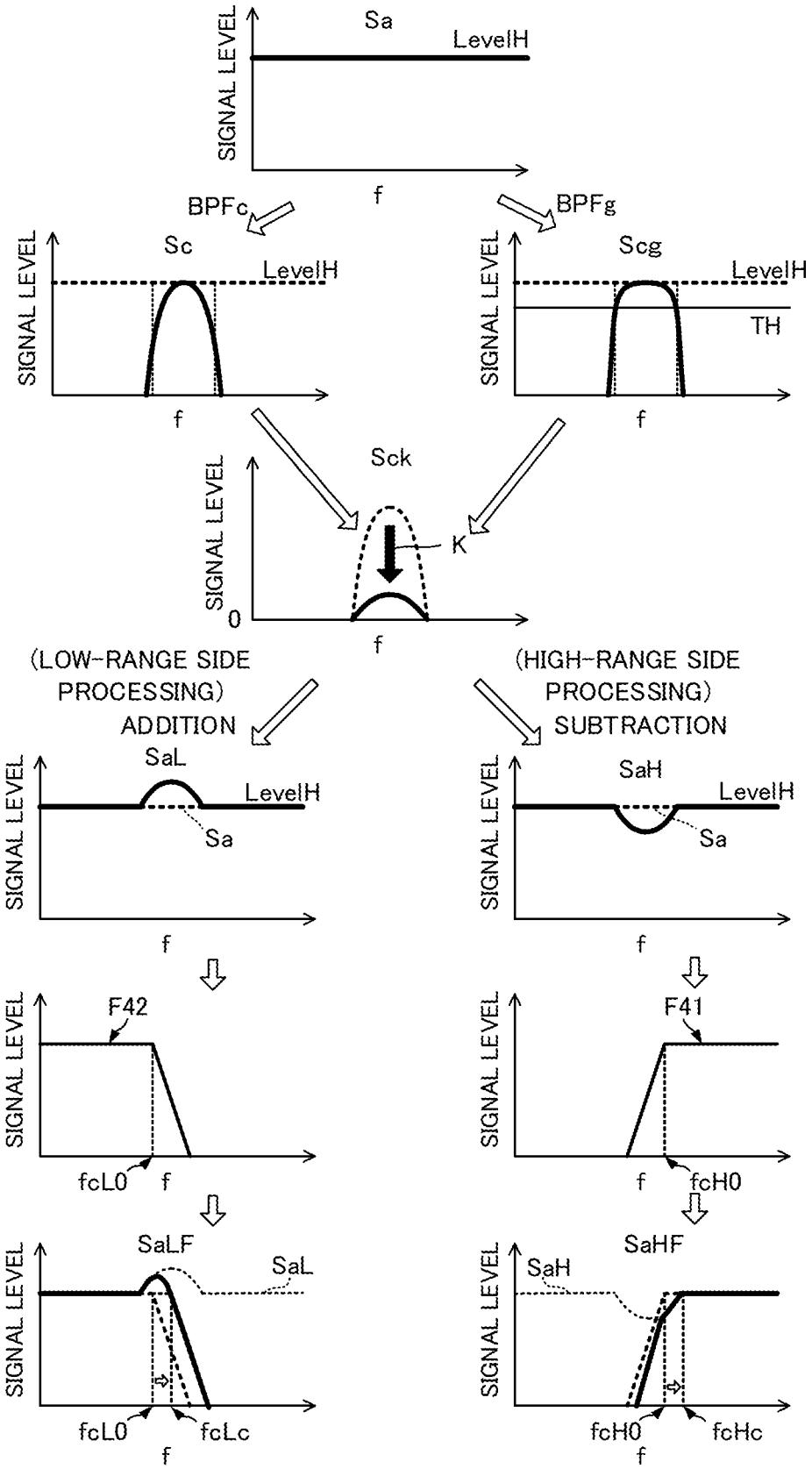
FIG. 5 is a view showing frequency characteristics about the signal level of each signal in the audio equipment 2, when the level of the audio signal Sa is high.

FIG. 5 is a view showing frequency characteristics about the signal level of each signal in the audio equipment 2 when the level of the audio signal Sa is high.

The adjustment signal Sc is a signal obtained by applying bandpass filter processing on the audio signal Sa. Therefore, a level of the adjustment signal Sc is substantially the same as the level of the audio signal Sa.

Similarly, the gain setting audio signal Scg is a signal obtained by applying bandpass filter processing on the audio signal Sa. Therefore, a level of the gain setting audio signal Scg is substantially the same as the level of the audio signal Sa. In this case, Q of the BPF 221 of the gain setter 22 differs from Q of the adjustment-signal extraction BPF 21. Thus, as shown in FIG. 4, frequency characteristics of the adjustment signal Sc differ from frequency characteristics of the gain setting audio signal Scg. As a result, the gain setting audio signal Scg and the adjustment signal Sc each have optimal frequency characteristics.

As shown in FIG. 5, the level of the gain setting audio signal Scg is more than or equal to the gain setting threshold TH. In this case, the gain K has a predetermined value so as not to decrease the level of the adjustment signal Sc to zero. Accordingly, as shown in FIG. 5, the adjustment signal Sck, which is subjected to the level adjustment, is a signal having a predetermined level, rather than zero, in only a predetermined frequency band including the above-mentioned crossover frequency. In other words, the level of the adjustment signal Sck, which is subjected to the level adjustment, is partially increased in the vicinity of the crossover frequency.

(Processing on Low-Range Side)

The low-range audio signal SaL is a signal obtained by adding the adjustment signal Sck, which is subjected to the level adjustment, to the audio signal Sa. The level of the adjustment signal Sck, which is subjected to the level adjustment, is partially increased in the vicinity of the crossover frequency. Therefore, as shown in FIG. 5, a level of the low-range audio signal SaL is partially increased in the vicinity of the crossover frequency relative to the audio signal Sa.

The low-range side filter 42 has a cutoff frequency fcL0 as shown in the frequency characteristic F42 of FIG. 5. The low-range side filter 42 applies filter processing on the low-range audio signal SaL. Thus, a low-range audio signal SaLF, which is subjected to the filter processing, has a frequency characteristic shown in FIG. 5 (graph on the left-hand side of the bottom).

As shown in FIG. 5, the low-range audio signal SaLF is a signal mainly having frequency components located on a lower side than the cutoff frequency fcL0 in the low-range audio signal SaL. Furthermore, the low-range audio signal SaL has a frequency band in which the level is partially increased. The frequency band in which the level is partially increased covers the cutoff frequency fcL0 of the low-range side filter 42. Thus, a low-range audio signal SaLF, which is subjected to the filter processing, has a predetermined signal level on a higher side than the cutoff frequency fcL0. The signal level on the higher side is comparable to a signal level located on a lower side than the cutoff frequency fcL0.

For this reason, the low-range audio signal SaLF, which is subjected to the filter processing, has the frequency characteristic whose cutoff frequency fcL0 is shifted to the higher side. More specifically, the frequency characteristic of the low-range audio signal SaLF, which is subjected to the filter processing, has a cutoff frequency fcLc higher than the cutoff frequency fcL0.

Therefore, if the level of the audio signal Sa is high, the audio equipment 2 can output the signal obtained by shifting the cutoff frequency of the low-range side filter 42 to the higher side, as the low-range audio signal SaLF subjected to the filter processing.

(Processing on High-Range Side)

The high-range audio signal SaH is a signal obtained by subtracting the adjustment signal Sck, which is subjected to the level adjustment, from the audio signal Sa. The level of adjustment signal Sck, which is subjected to the level adjustment, is partially increased in the vicinity of the crossover frequency. Therefore, as shown in FIG. 5, a level of the high-range audio signal SaH is partially decreased in the vicinity of the crossover frequency relative to the audio signal Sa.

The high-range side filter 41 has a cutoff frequency fcH0 as shown in the frequency characteristic F41 of FIG. 5. The high-range side filter 41 applies filter processing on the high-range audio signal SaH. Thus, a high-range audio signal SaHF, which is subjected to the filter processing, shown in FIG. 5 has a frequency characteristic shown in FIG. 5 (graph on the right-hand side of the bottom).

As shown in FIG. 5, the high-range audio signal SaHF is a signal mainly having frequency components located on a higher side than the cutoff frequency fcH0 in the high-range audio signal SaH. Furthermore, the high-range audio signal SaH has a frequency band in which the level is partially decreased. The frequency band in which the level is partially decreased covers the cutoff frequency fcH0 of the high-range filter 41. Thus, a signal level of the high-range audio signal SaHF, which is subjected to the filter processing, has a decreased portion on a higher side than the cutoff frequency fcH0.

For this reason, the high-range audio signal SaHF, which is subjected to the filter processing, has the frequency characteristic whose cutoff frequency fcH0 is shifted to the higher side. More specifically, the frequency characteristic of the high-range audio signal SaHF, which is subjected to the filter processing, has a cutoff frequency fcHc higher than the cutoff frequency fcH0.

Therefore, if the level of the audio signal Sa is high, the audio equipment 2 can output the signal obtained by shifting the cutoff frequency of the high-range filter to the higher side, as the high-range audio signal SaHF subjected to the filter processing.

Thus, if the level of the audio signal Sa is high, the audio equipment 2 can shift the cutoff frequency of the high-range side filter 41 and the cutoff frequency of the low-range side filter 42 to the higher side. In other words, the audio equipment 2 can shift the crossover frequency to the higher side.

Usually, an output tolerance level of the high-range speaker 501 is lower than an output tolerance level of the low-range speaker 502. For this reason, when a level of the audio signal Sa becomes high, thereby increasing an input to the high-range speaker 501, sound quality deteriorates and balance of sounds also collapses. By using the configurations of the audio signal control circuit 10 and the audio equipment 2, however, the cutoff frequency is made substantially higher when the level of the audio signal Sa is high. Therefore, a load of the high-range speaker 501 is reduced, thereby preventing the deterioration of sound quality and making the balance of sounds stable.

Note that, the above-mentioned description shows only an example in which the level of the audio signal Sa is high. If the above-mentioned configuration is provided, however, a shift amount of the cutoff frequency will be changed according to the level of the audio signal Sa, when the level of the audio signal Sa is more than or equal to the gain setting threshold TH. Thus, the deterioration of sound quality is prevented and the balance of sounds is made stable, without being affected by sound volume.

Further, by using the above-mentioned configuration, the audio signal control circuit 10 can cause a waveform of the adjustment signal Sc to differ from a waveform of the gain setting audio signal Scg. Thus, the audio signal control circuit 10 can adjust the adjustment signal Sc to a suitable waveform for controlling the cutoff frequency. In other words, by using the audio signal control circuit 10, a bandwidth of the adjustment signal Sc is matched to a frequency width caused by the shift of the crossover frequency. Thus, the audio equipment 2 can optimize the level characteristics in the vicinity of the crossover frequency (in the vicinity of the cutoff frequency). Further, the audio signal control circuit 10 can adjust the gain setting audio signal Scg to a suitable waveform for detecting the level of the audio signal Sa. Thus, the audio signal control circuit 10 can detect the level of the audio signal Sa with high precision.

Further, by using the above-mentioned configuration, the high-range side filter 41 and the low-range side filter 42 do not need to be variable filters. Furthermore, the audio signal control circuit 10 can simplify a circuit configuration for shifting the cutoff frequency. This makes it possible to reduce resources of the audio signal control circuit 10 and the audio equipment 2.

Further, by adjusting the level of adjustment signal Sc, the audio equipment 2 can optimize a shift amount of the cutoff frequency, as mentioned above.

(Description of Audio Signal Control Method)

Figure 6:
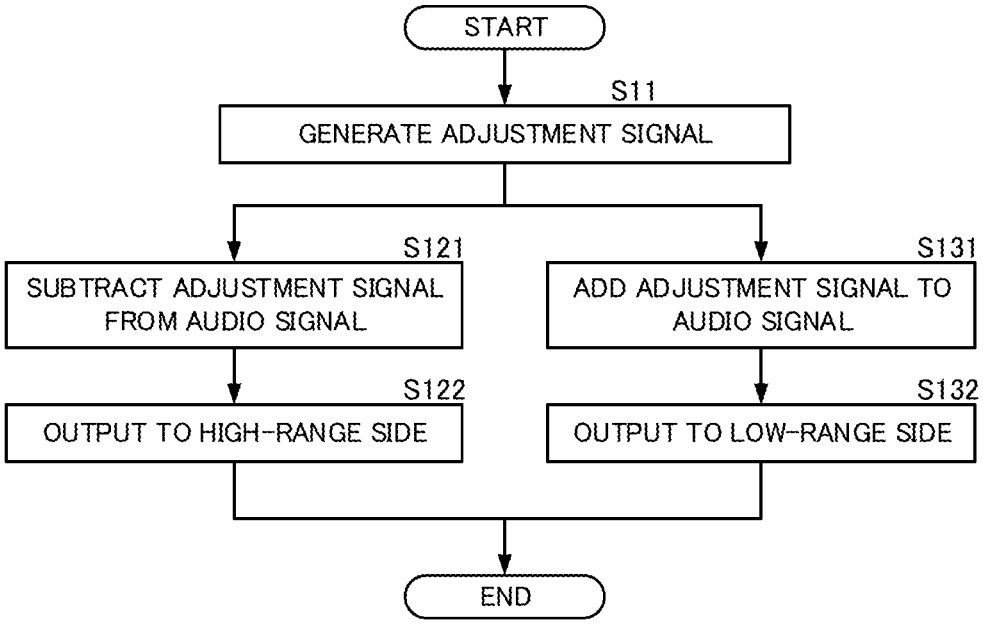
FIG. 6 is a flowchart showing a main processing of an audio signal control method.
Figure 7:
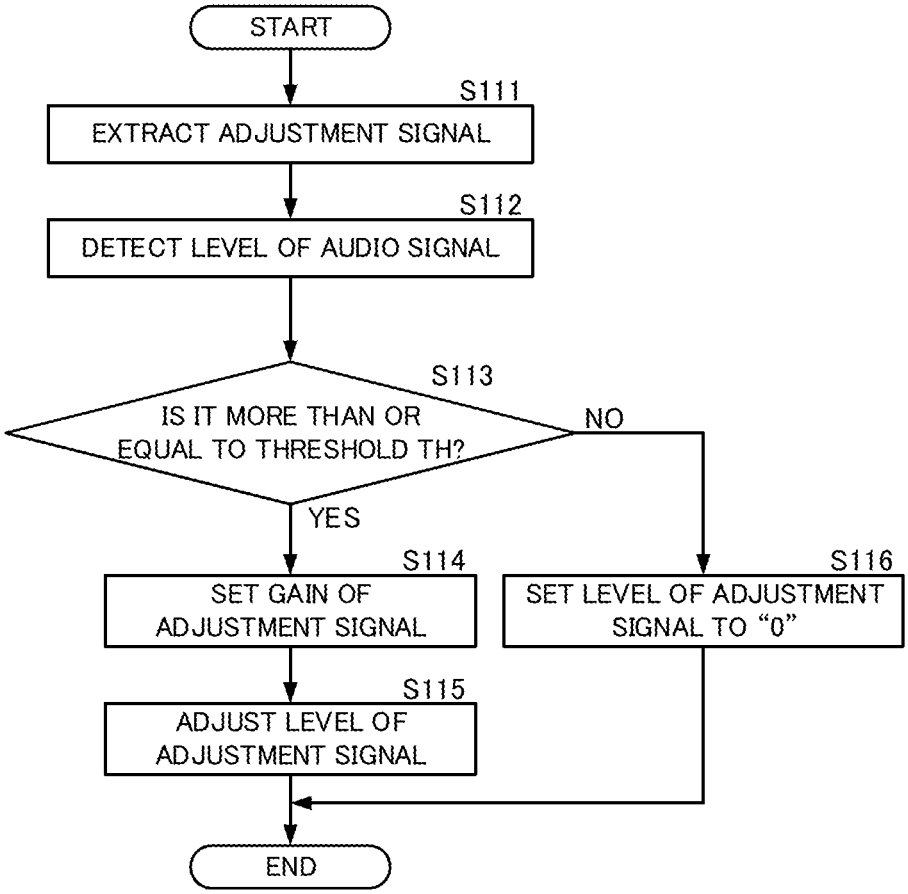
FIG. 7 is a flowchart showing generation processing of an adjustment signal.

FIG. 6 is a flowchart showing main processing of an audio signal control method. FIG. 7 is a flowchart showing generation processing of an adjustment signal. Note that, since the concrete contents of each processing have been described above, the description thereof will be omitted in the following.

A calculation device generates an adjustment signal Sc from an audio signal Sa (FIG. 6: S11). More specifically, the calculation device applies bandpass filter processing on the audio signal Sa to extract and generate the adjustment signal Sc (FIG. 7: S111). The calculation device detects a level of the audio signal Sa subjected to the bandpass filter processing (FIG. 7: S112).

If the level of the audio signal Sa is more than or equal to a gain setting threshold TH (FIG. 7: S113: YES), the calculation device will set a gain K of the adjustment signal Sc to a predetermined value (FIG. 7: S114). The calculation device multiplies the adjustment signal Sc by the gain K to adjust the level of the adjustment signal Sc (FIG. 7: S115). If the level of the audio signal Sa is less than the gain setting threshold TH (FIG. 7: S113: NO), the calculation device will set the gain K so as to decrease the level of the adjustment signal Sc to "zero" (FIG. 7: S116).

The calculation device subtracts an adjustment signal Sck, which is subjected to the level adjustment, from the audio signal Sa (S121), and outputs it to the high-range side filter 41 (S122). The calculation device adds the adjustment signal Sck, which is subjected to the level adjustment, to the audio signal Sa (S131), and outputs it to the low-range filter 42 (S132).

(Configuration of Adjustment Signal Generator 20A)

Figure 8:
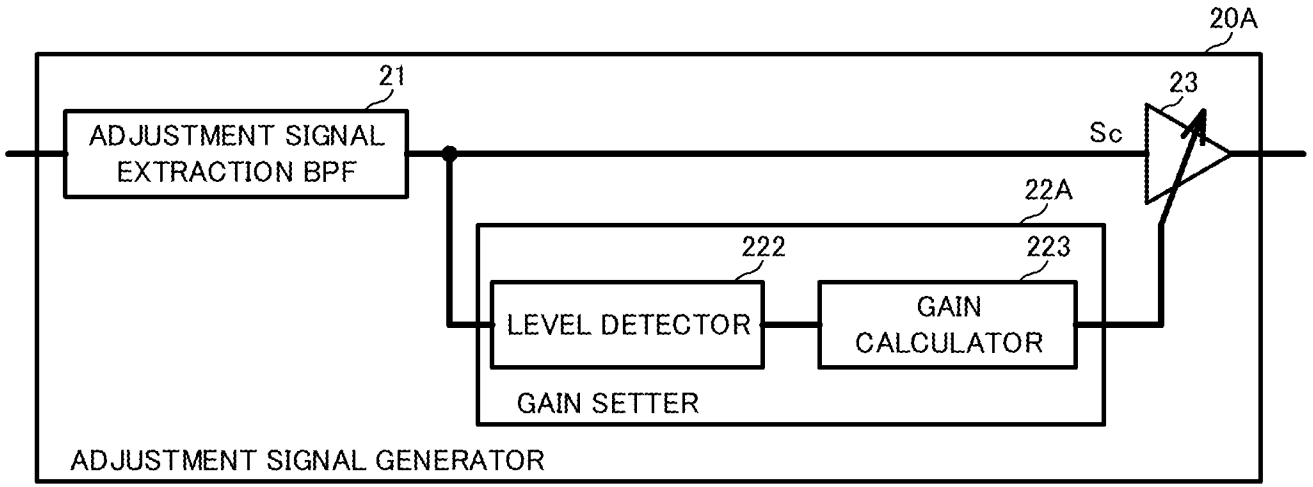
FIG. 8 is a block diagram showing a configuration of an adjustment signal generator 20A.

An adjustment signal generator may be the configuration shown in FIG. 8. FIG. 8 is a block diagram showing a configuration of an adjustment signal generator 20A. In the following, about the same parts as in the adjustment signal generator 20, the description thereof will be omitted in the adjustment signal generator 20A.

The adjustment signal generator 20A includes the adjustment-signal extraction BPF 21, a gain setter 22A, and the level adjuster 23. The gain setter 22A includes a level detector 222 and a gain calculator 223. The adjustment-signal extraction BPF 21 outputs the adjustment signal Sc to the level detector 222 and the level adjuster 23.

With such a configuration, the adjustment signal generator 20A can omit the BPF that extracts the gain setting audio signal. This simplifies the configuration of the adjustment signal generator 20A more.

(Configuration of Sound System 1A and Audio Equipment 2A)

Figure 9:
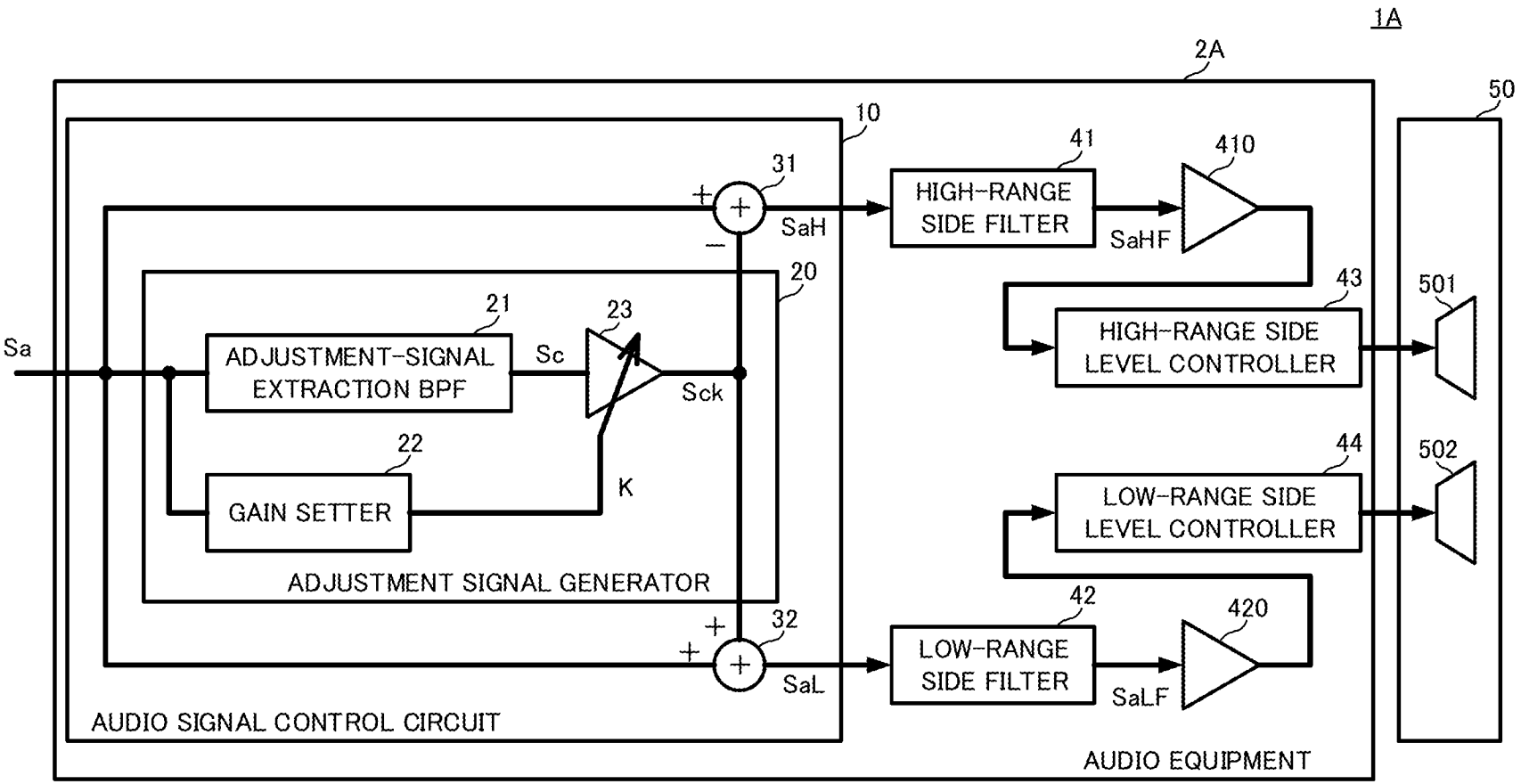
FIG. 9 is a block diagram showing a configuration of a sound system 1A.

A sound system and audio equipment may be the configuration shown in FIG. 9. FIG. 9 is a block diagram showing a configuration of a sound system 1A. In the following, about the same part as in the sound system 1, the description thereof will be omitted in the sound system 1A.

The sound system 1A includes audio equipment 2A and a speaker device 50. The audio equipment 2A includes the audio signal control circuit 10, the high-range side filter 41, the low-range side filter 42, the high-range amplifier 410, the low-range amplifier 420, a high-range side level controller 43, and a low-range side level controller 44.

The high-range side level controller 43 is, so called, a limiter circuit or a compressor circuit. The high-range side level controller 43 is connected to an output side of the high-range amplifier 410, and is connected to the high-range speaker 501. Note that, the high-range side level controller may be connected to an input side of the high-range amplifier 410.

The low-range side level controller 44 is, so called, a limiter circuit or a compressor circuit. The low-range side level controller 44 is connected to an output side of the low-range amplifier 420, and is connected to the low-range speaker 502. Note that, the low-range side level controller may be connected to an input side of the low-range amplifier 420.

As mentioned above, when an output tolerance level of the high-range speaker 501 is lower than an output tolerance level of the low-range speaker 502, a limiting threshold set in the high-range side level controller 43 is lower than a limiting threshold set in the low-range side level controller 44. In this case, if the level of the audio signal Sa becomes high, the high-range side level controller 43 will perform level control before the low-range side level controller 44 does. In this case as well, the deterioration of sound quality, mentioned above, will occur. If the configurations of the audio signal control circuit 10 and the audio equipment 2A are provided, however, the high-range side level controller 43 will restrict the level control. This makes it difficult to cause the deterioration of sound quality.

(Configuration of Sound System 1B)

Figure 10:
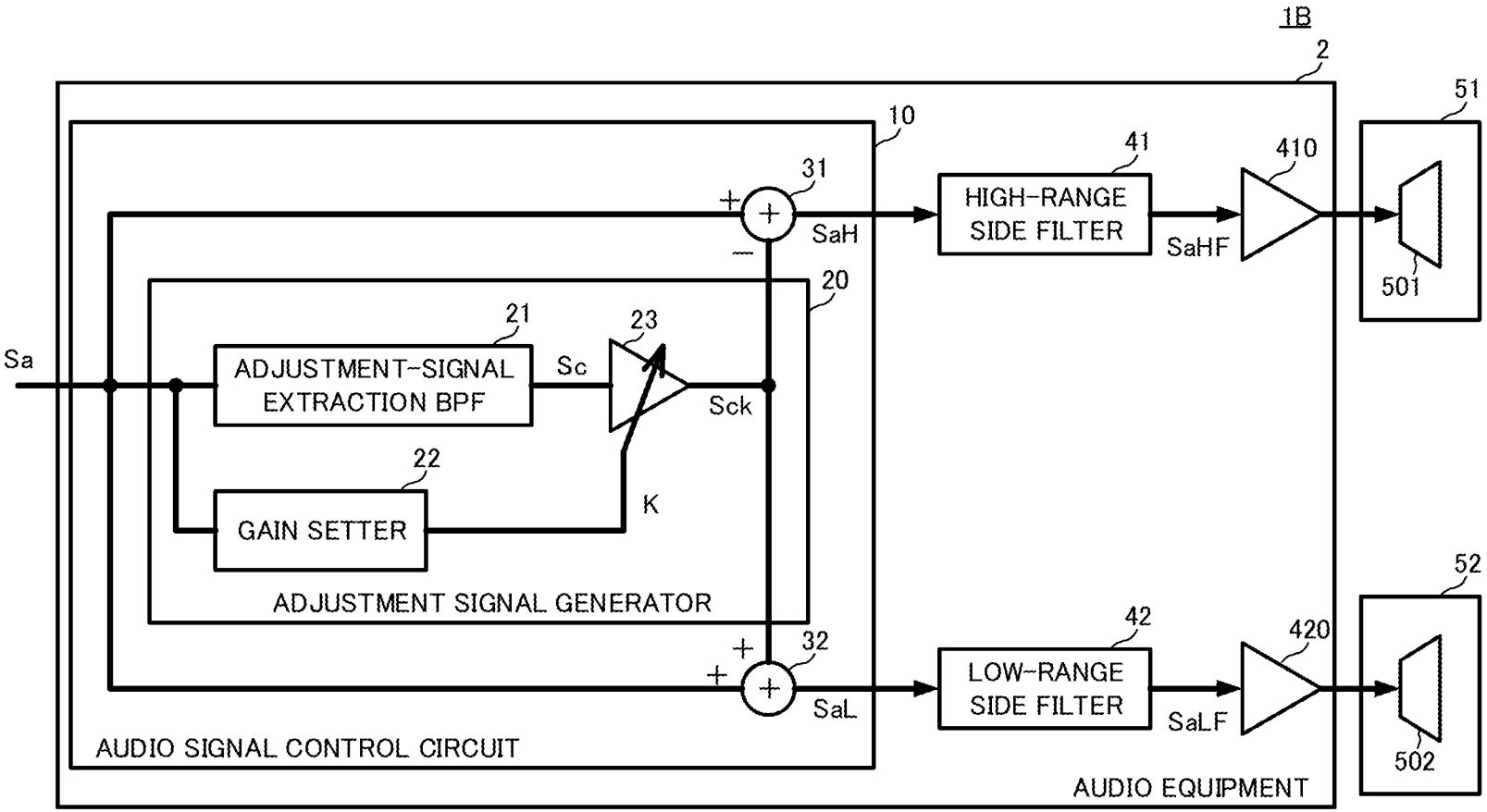
FIG. 10 is a block diagram showing a configuration of a sound system 1B.

A sound system may be the configuration shown in FIG. 10. FIG. 10 is a block diagram showing a configuration of a sound system 1B. In the following, about the same part as in the sound system 1, the description thereof will be omitted in the sound system 1B.

The sound system 1B includes the audio equipment 2, a speaker device 51, and a speaker device 52. The speaker device 51 includes a high-range speaker 501. The speaker device 52 includes a low-range speaker 502. In this way, in the sound system 1B, the high-range speaker 501 and the low-range speaker 502 are separated from each other. Even in such a configuration, the sound system 1B obtains the same operational advantages as in the above-mentioned sound system 1.

Note that, an aspect of sound emission is not limited to the above-mentioned manner. Specifically, the sound system may include the high-range speaker 501 and the low-range speaker 502. For instance, the sound system may use an earphone or a headphone equipped with the high-range speaker 501 and the low-range speaker 502. Further, the sound system may be configured to transmit the high-range audio signal SaHF, which is subjected to the filter processing, and the low-range audio signal SaLF, which is subjected to the filter processing, through the communications network or the like. The sound system uses the high-range speaker 501 to emit the transmitted high-range audio signal SaHF, which is subjected to the filter processing, as sounds. Further, the sound system uses the low-range speaker 502 to emits the transmitted low-range audio signal SaLF, which is subjected to the filter processing, as sounds.

The description of the present embodiment is illustrative in all respects, and should not be construed to be restrictive. The scope of the present invention is indicated by the appended claims rather than by the above-mentioned embodiments. Furthermore, the scope of the present invention is intended to include all modifications within the meaning and range equivalent to the scope of the claims.

What is claimed is:

1. An audio signal control circuit comprising:

an adjustment signal generator that extracts a frequency band to generate an adjustment signal, the frequency band including a frequency at which a frequency band shared by a low-range speaker and a frequency band shared by a high-range speaker overlap each other;

a high-range outputter that subtracts the adjustment signal from an audio signal to generate a high-range audio signal and outputs the high-range audio signal to a high-pass filter; and a low-range outputter that adds the adjustment signal to the audio signal to generate a low-range audio signal and outputs the low-range audio signal to a low-pass filter, wherein the adjustment signal generator comprises:

a first bandpass filter that extracts the adjustment signal from the audio signal;

a gain setter that uses a level of the audio signal to set a gain with respect to the adjustment signal; and a level adjuster that uses the gain to adjust a level of the adjustment signal.

2. The audio signal control circuit according to claim 1, wherein the gain setter comprises:

a second bandpass filter whose pass band includes a frequency band extracted in the adjustment signal generator;

a level detector that detects an output level of the second bandpass filter; and a gain calculator that uses a result of the level detector to set the gain.

3. The audio signal control circuit according to claim 1, wherein, when the frequency band extracted in the adjustment signal generator is varied, a width of a pass band of the first bandpass filter is set depending on a width of the varied frequency band.

4. An audio signal control method comprising:

extracting a frequency band to generate an adjustment signal, the frequency band including a frequency at which a frequency band shared by a low-range speaker and a frequency band shared by a high-range speaker overlap each other;

subtracting the adjustment signal from an audio signal to generate a high-range audio signal, and outputting the high-range audio signal to a high-pass filter;

adding the adjustment signal to the audio signal to generate a low-range audio signal, and outputting the low-range audio signal to a low-pass filter;

extracting the adjustment signal from the audio signal;

setting a gain with respect to the adjustment signal based on a level of the audio signal; and using the gain to adjust a level of the adjustment signal.

5. The audio signal control method according to claim 4, comprising:

extracting a gain setting audio signal that includes a frequency band within a pass band, the frequency band being extracted to generate the adjustment signal;

detecting a level of the gain setting audio signal; and setting the gain based on the level.

6. The audio signal control method according to claim 4, wherein, when the frequency band extracted to generate the adjustment signal is varied, a width of a pass band of the adjustment signal is set depending on a width of the varied frequency band.

* * * * *